US008253351B2

(12) United States Patent
Yamamoto et al.

(10) Patent No.: US 8,253,351 B2
(45) Date of Patent: Aug. 28, 2012

(54) ELECTRONIC BALLAST WITH MULTIMODE LAMP POWER CONTROL

(75) Inventors: Masafumi Yamamoto, Osaka (JP); Tetsuya Hamana, Nara (JP); Hiroyuki Asano, Nara (JP)

(73) Assignee: Panasonic Corporation, Osaka (JP)

( * ) Notice: Subject to any disclaimer, the term of this patent is extended or adjusted under 35 U.S.C. 154(b) by 478 days.

(21) Appl. No.: 12/492,016

(22) Filed: Jun. 25, 2009

(65) Prior Publication Data

US 2010/0033101 A1 Feb. 11, 2010

(30) Foreign Application Priority Data

Jun. 25, 2008 (JP) ..... 2008-166262

(51) Int. Cl.
*G05F 1/00* (2006.01)

(52) U.S. Cl. ..... 315/307; 315/128; 315/209 R; 315/224; 315/244

(58) Field of Classification Search ..... 315/225, 315/119, 307, DIG. 5, 107, 106, 277, 220
See application file for complete search history.

(56) References Cited

U.S. PATENT DOCUMENTS

| | | | | |
|---|---|---|---|---|
| 5,751,115 | A * | 5/1998 | Jayaraman et al. | 315/225 |
| 2005/0035729 | A1 * | 2/2005 | Lev et al. | 315/291 |
| 2006/0087259 | A1 * | 4/2006 | Fiorello | 315/291 |
| 2006/0244395 | A1 * | 11/2006 | Taipale et al. | 315/277 |

FOREIGN PATENT DOCUMENTS

JP 2000030887 1/2000

* cited by examiner

*Primary Examiner* — Shawki S Ismail
*Assistant Examiner* — Christopher Lo
(74) *Attorney, Agent, or Firm* — Waddey & Patterson, P.C.; Mark J. Patterson; Mark A. Pitchford

(57) ABSTRACT

A control means has an adjustment function in a microprocessor to adjust variations in an output to a discharge lamp due to variations in components by correcting a duty ratio of a PWM signal for varying an operating frequency of an inverter circuit so that a detected value of a second detection circuit falls within a target range. The microprocessor switches paths to transmit the PWM signal between a path passing through a feedback circuit and a path passing through a voltage follower circuit by switches a switch circuit to supply the signal through the path passing through the voltage follower circuit in adjusting output variations in the preheating mode and the starting mode.

13 Claims, 11 Drawing Sheets

ELECTRONIC BALLAST WITH MULTIMODE LAMP POWER CONTROL

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

CROSS-REFERENCES TO RELATED APPLICATIONS

This application claims benefit of the following patent application(s) which is/are hereby incorporated by reference: Japanese Patent Application No. JP2008-166262 filed on Jun. 25, 2008

STATEMENT REGARDING FEDERALLY SPONSORED RESEARCH OR DEVELOPMENT

Not Applicable

REFERENCE TO SEQUENCE LISTING OR COMPUTER PROGRAM LISTING APPENDIX

Not Applicable

BACKGROUND OF THE INVENTION

The present invention relates to electronic ballasts and a lighting fixture using the same.

Electronic ballasts for powering a discharge lamp such as a fluorescent lamp are well known. On example of a conventional electronic ballast is shown in FIG. 10, and includes a DC converting circuit 1 for converting an output of an AC power source AC into a DC output, an inverter circuit 2 for converting the DC outputted from the DC converting circuit 1 into a high frequency output, a resonant circuit 3 having a series resonant circuit formed of an inductor L2 connected to an output end of the inverter circuit 2 and a capacitor C2, and a discharge lamp La powered by an output of the inverter circuit 2, and a control circuit 4 for controlling operations of the DC converting circuit 1 and the inverter circuit 2.

The DC converting circuit 1 includes a diode bridge DB, a series circuit formed of an inductor L1 and a diode D1, which is connected to an output on a high-voltage side of the diode bridge DB, and a step-up chopper power factor correction (PFC) circuit formed of a switching element Q1 connected between output ends of the diode bridge DB through the inductor L1, and a capacitor C1 connected to the switching element Q1 in parallel through the diode D1. In the DC converting circuit 1, the diode bridge DB rectifies an output voltage from the AC power source AC, and a DC control circuit 4*a* described later turns on/off the switching element Q1 through the driver 4*b* to convert the output voltage from the diode bridge DB into a desired DC voltage. The DC output voltage is smoothed by the capacitor C1. Furthermore, the power factor of an input current is corrected by bringing the input current to close to a sinusoidal current.

The inverter circuit 2 includes switching elements Q2, Q3 connected in series between across capacitor C1, and a capacitor C3, one end of which is connected to a connection center point of the switching elements Q2, Q3. A microcontroller 4*c* described later alternately turns on/off the switching elements Q2, Q3 through the driver 4*d* to convert the output voltage from the DC converting circuit 1 into a high-frequency AC voltage and feeds the AC voltage to a discharge lamp La of the resonant circuit 3. The capacitor C3 blocks DC components from the AC voltage and is charged at turn-on of the switching element Q2 to act as a power source for supplying power to the discharge lamp La at turn-on of the switching element Q3.

The resonant circuit 3 is a series circuit formed of an inductor L2 and a capacitor C2, which is connected between the other end of the capacitor C3 and a low-voltage side of the series circuit including the switching elements Q2, Q3, and the discharge lamp La connected to the capacitor C2 in parallel. The capacitor C2 is a preheating capacitor and along with the current-limiting inductor L2, constitutes a series resonant circuit.

The control circuit 4 includes the DC control circuit 4*a*, a driver 4*b* for turning on/off the switching element Q1 according to an output signal of the DC control circuit 4*a*, the microcontroller 4*c* and a driver 4*d* for turning on/off the switching elements Q2, Q3 according to an output signal of the microprocessor 4*c*.

There is provided in the electronic ballast of FIG. 10 a feedback circuit in the control circuit 4 to control power supplied to the discharge lamp La to be substantially constant by detecting a signal in proportional to the power supplied to the discharge lamp La, comparing the detected value with a reference value and performing feedback control.

FIG. 11(*a*) shows the frequency response characteristic of the resonant circuit 3 in the example of FIG. 10. A resonant curve Sa during non-lighting of the discharge lamp La is determined mainly by the inductor L2 and the capacitor C2. The resonant curve Sb obtained during lighting of the discharge lamp La is determined by the impedance of the discharge lamp La in addition to the inductor L2 and the capacitor C2.

When a main power source is turned on, the inverter circuit 2 operates with an operating frequency at which such voltage that does not ignite the discharge lamp La is applied to the discharge lamp La to preheat filaments F1, F2 at both ends of the discharge lamp La. The inverter operating frequency is changed so that a voltage sufficiently large to start the discharge lamp La is applied to the discharge lamp La. After lamp ignition, by changing the operating frequency to a frequency according to a dimming level, the discharge lamp La is normally lighted. Accordingly, in prior preheating and starting before the discharge lamp La is ignited, the frequency characteristic of the resonant circuit 3 follows the resonant curve Sa during non-lighting, and after lighting of the discharge lamp La, the frequency characteristic of the resonant circuit 3 follows the resonant curve Sb.

The variations in the resonant curve Sa during non-lighting and the resonant curve Sb in lighting occur due to variations in components of the inductor L2 and the capacitor C3. For example, as shown in FIG. 11(*b*), given that the operating frequency of the inverter circuit 2 in lighting is f1, variations shown at "d" occur in the resonant curve Sb in lighting due to variations in the components of the inductor L2 and the capacitor C2, causing output variations shown at "a". Frequency variations shown at "c" also occur in the operating frequency of the inverter circuit 2 due to variations in components forming the control circuit 4. For example, given that the operating frequency varies from f3 to f2 (f3<f1<f2), the output varies according to b". The above-mentioned variations, as shown in FIG. 11(*c*), also apply to variations in non-lighting, that is, during preheating and starting.

To prevent the above-mentioned variations, for example, a variable resistor is generally used as a resistor for setting the operating frequency so as to perform a fine adjustment. However, when fine adjustment is performed using the variable resistor, an adjustment process using the variable resistor is required in a manufacturing process of the electronic ballast, disadvantageously resulting in lowering of productivity.

Thus, in the above-mentioned example, variations in the operating frequency are eliminated by setting the operating frequency by use of the microprocessor 4*c* in the circuit for controlling operations of the switching elements Q2, Q3. In a device described in Japanese Unexamined Patent Publication No. 2001-326089, a detecting circuit (not shown) for detecting, for example, a voltage V1 across the discharge lamp La and a current supplied to the discharge lamp La is provided, an output of the detecting circuit is inputted to a terminal having an A/D converting function in the microprocessor 4*c*, and a suitable operating frequency is selected based on the inputted value to drive the switching elements Q2, Q3. In this manner, variations in the output are narrowed and the electronic ballast can be manufactured without using the variable resistor.

However, in the above-mentioned example, in the case where the feedback circuit as described in Japanese Unexamined Patent Publication No. 2001-326089 is provided, there have been problems. When a delay time of the feedback circuit is set in accordance with the resonant frequency in lighting, in adjusting the resonant frequency in preheating and starting, the resonant frequency in preheating and starting becomes higher than the resonant frequency in lighting and thus, the delay time with respect to the resonant frequency becomes longer. Moreover, for frequency characteristics in preheating and starting, since the voltage applied to the discharge lamp La changes sharply in response to change in the frequency, feedback control of the feedback circuit cannot keep up with the change, and as shown in FIG. 12, since amplitude of the voltage applied to the discharge lamp La varies, the resonant frequency in preheating and starting cannot be adjusted.

In adjusting the resonant frequency in preheating and starting, since the voltage applied to the discharge lamp La changes sharply relative to change in frequency, when the operating frequency falls below a frequency lower than an adjustment range in the adjustment process, a high voltage occurs. For this reason, in consideration of stress applied on components of the circuit due to application of the high voltage, it is necessary to use more robust and more expensive components.

BRIEF SUMMARY OF THE INVENTION

The present invention has been made in consideration of the above-mentioned problems, and an object of the present invention is to provide an electronic ballast capable of adjusting the resonant frequency in preheating and starting even in the configuration provided with a feedback circuit.

To attain the above-mentioned object, a first aspect of the present invention provides an electronic ballast including a DC converting circuit for converting an AC output from a commercial power source into a DC output, an inverter circuit for converting an output from the DC converting circuit to a high frequency output, a resonant circuit connected to an output end of the inverter circuit, the resonant circuit having a series resonant circuit formed of an inductor and a capacitor, and a discharge lamp with the high frequency output supplied thereto from the inverter circuit.

Also included are control means having three operating modes including a preheating mode for preheating a filament of the discharge lamp, a starting mode for applying a starting voltage to the discharge lamp, and a lighting mode for supplying power to maintain lighting of the discharge lamp and for feeding a control signal to vary an operating frequency of the inverter circuit according to each operating mode to the inverter circuit. The electronic ballast may also include a first detection circuit for detecting an output of the inverter circuit, a second detection circuit for detecting a voltage across the discharge lamp, and a feedback circuit for performing feedback control so that a detected value of the first detection circuit may substantially coincide with a predetermined value, wherein the control means has an adjustment function to adjust variations in the output to the discharge lamp due to variations in components. The adjustment function causes a storage circuit to store a set value of the control signal in accordance with an operating frequency previously set in the inverter circuit in each of the preheating mode, the starting mode and the lighting mode and a target range in accordance with an output to the discharge lamp and to store a corrected set value obtained by correcting the set value so that a detected value of the second detection circuit falls within the target range. The control means switches paths to supply the control signal corresponding to the set value to the inverter circuit between a path passing through the feedback circuit and a path without passing through the feedback circuit and supplies the control signal to the inverter circuit by selecting the path without passing through the feedback circuit at least at adjustments in the preheating mode and the starting mode.

In a electronic ballast from a second aspect of the present invention according to the first aspect of the present invention, the set value in the starting mode is corrected so that an output to the corresponding discharge lamp may change from a lower value than an output to the discharge lamp in accordance with the target range in the mode toward the target range.

In a electronic ballast in a third aspect of the present invention according to the first or second aspect of the present invention, a third detection circuit for detecting an output of the DC converting circuit is further provided, and the control means has a function to stop an operation of the inverter circuit and adjust the output of the DC converting circuit so that a detected value of the third detection circuit may fall within the target range.

A fourth aspect of the present invention provides a lighting fixture including a fixture main body, a socket in the fixture main body with a discharge lamp removably attached thereto, and the electronic ballast according to any one of the first to third aspect of the present inventions for supplying power to the discharge lamp through the socket.

According to the first aspect of the present invention, since the electronic ballast includes the first detection circuit for detecting the output of the inverter circuit and the feedback circuit for performing feedback control so that the detected value of the first detection circuit may substantially coincide with a predetermined value, power supplied to the discharge lamp can be controlled to be substantially constant. Moreover, the control means has the adjustment function to adjust variations in the output to the discharge lamp due to variations in components and when performing adjustments in the preheating mode and the starting mode, transmits the control signal to the inverter circuit through the path without passing through the feedback circuit. It is therefore possible to prevent the feedback circuit from affecting the output of the inverter circuit at the adjustments in the preheating mode and the starting mode, so that highly accurate adjustment can be performed both in the preheating mode and the starting mode.

According to the second aspect of the present invention, since at adjustment in the starting mode, the output to the discharge lamp at start of adjustment is lower than the output to the discharge lamp in accordance with the target range, the possibility that the output to the discharge lamp becomes higher than the output to the discharge lamp in accordance with the target range in the process of adjustment can be lowered, thereby reducing high voltage stress on the components.

According to the third aspect of the present invention, variations in the output of the DC converting circuit due to variations in the components forming the DC converting circuit can be adjusted, thereby enabling adjustment of the output of the DC converting circuit with high accuracy.

According to the fourth aspect of the present invention, a lighting fixture capable of achieving an effect of any one of the first to third aspects of the present invention can be realized.

DETAILED DESCRIPTION OF THE INVENTION

Figure 1:
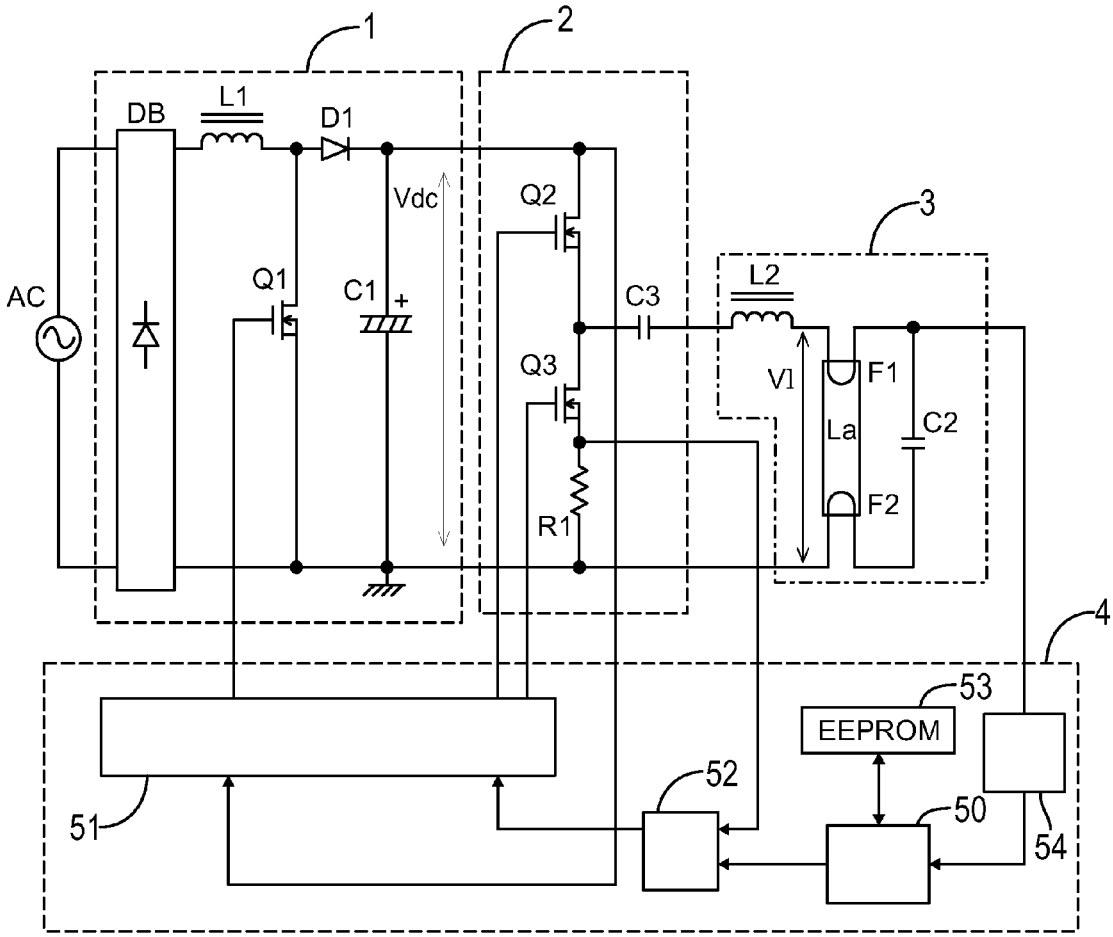
FIG. 1 is a circuit diagram showing a first embodiment of an electronic ballast according to the present invention.
Figure 10:
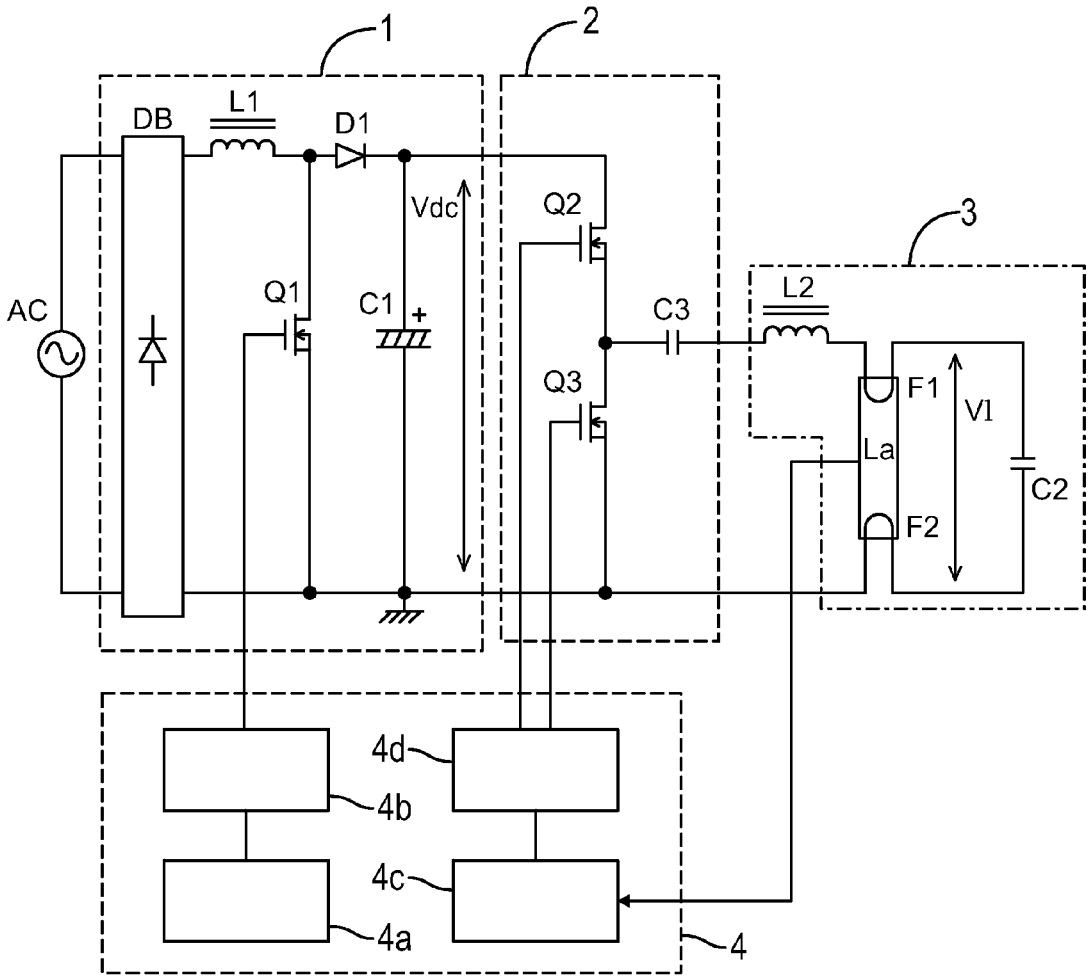
FIG. 10 is a circuit diagram showing a conventional electronic ballast.

A first embodiment of an electronic ballast according to the present invention will be described below referring to figures. The present embodiment includes, as shown in FIG. 1, a DC converting circuit 1 for converting an output from an AC power source AC into a DC output, an inverter circuit 2 for converting the DC output from the DC converting circuit 1 into a high frequency output, a resonant circuit 3 which is connected to an output end of the inverter circuit 2 and has a series resonant circuit formed of an inductor L2 and a capacitor C2, and a discharge lamp La with the high frequency output supplied thereto from the inverter circuit 2. This embodiment also includes a detecting resistor R1 corresponding to a first detection circuit for detecting an output of the inverter, and a control circuit 5 adapted to control operation of the DC converting circuit 1 and the inverter circuit 2. The configuration of the DC converting circuit 1, the inverter circuit 2 and the resonant circuit 3 are similar to that in the prior art example of FIG. 10, common circuits are given the same reference numerals and description thereof is omitted.

The control circuit 5 includes a microprocessor 50 for outputting a pulse width modulated (PWM) control signal for varying the operating frequency of the inverter circuit 2, and a driver 51 for feeding a driving signal for driving switching elements Q1, Q2, Q3. A switch circuit 52 may be included for switching paths provided between the microprocessor 50 and the driver 51 to transmit the PWM signal from the microprocessor 50 to the driver 51 between a path passing through a feedback circuit 52*a* described later and a path passing through a voltage follower circuit 52*b* described later. A second detection circuit 54 is used for detecting a voltage V1 across the discharge lamp La.

The microprocessor 50 has three operating modes including a preheating mode for preheating filaments F1, F2 of the discharge lamp La, a starting mode for applying a starting voltage to the discharge lamp La, and a lighting mode for feeding power to maintain lighting of the discharge lamp La. The microprocessor reads a duty ratio (set value) from an EEPROM 53 for each operating mode and outputs a PWM signal according to the duty ratio. The EEPROM 53 stores an initial value of the duty ratio previously set in accordance with the operating frequency in each mode and a target range in accordance with a target output to the discharge lamp La in each mode therein. Although the EEPROM 53 in the present embodiment is a nonvolatile memory provided outside of the microprocessor 50, it may be provided within the microprocessor 50.

Figure 2:
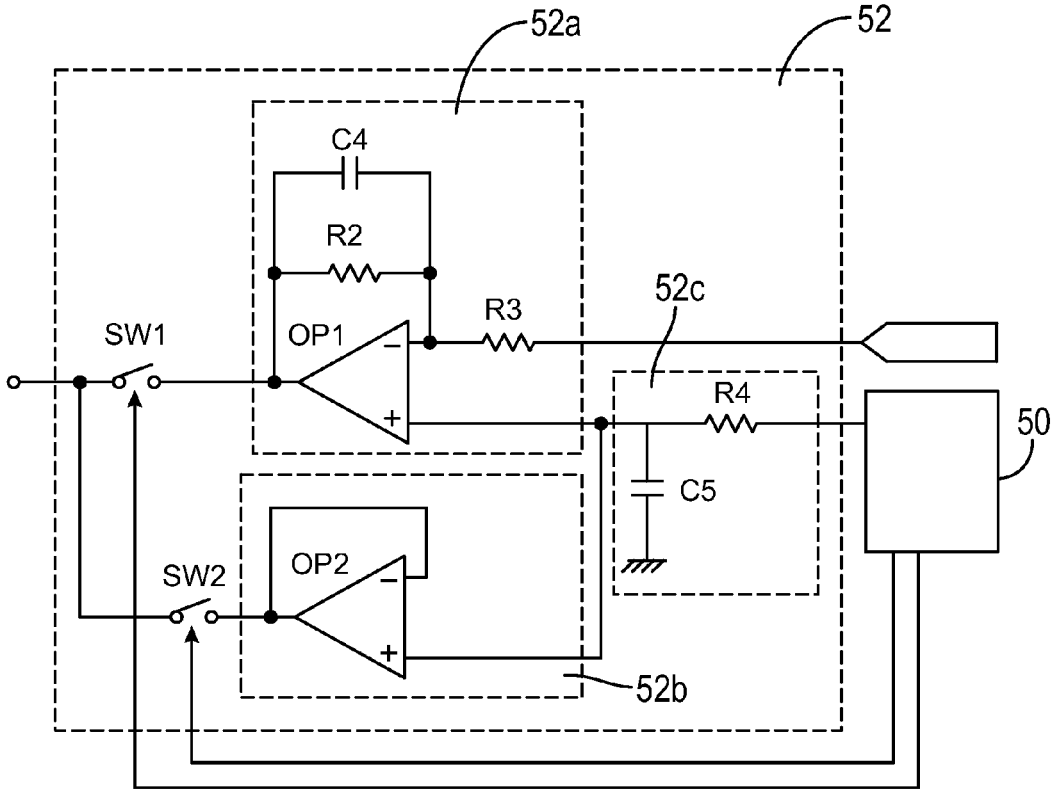
FIG. 2 is a circuit diagram showing a transmission path of a PWM signal used in the first embodiment.

The switch circuit 52 has, as shown in FIG. 2, a feedback circuit 52*a* formed from an operational amplifier OP1, a resistor R2 and a capacitor C4 which are connected in parallel between an inverting input terminal and an output terminal of the operational amplifier OP1 and a resistor R3 connected to the inverting input terminal, and a voltage follower circuit 52*b* in which an inverting input terminal and an output terminal of an operational amplifier OP2 are short-circuited, and the PWM signal is inputted from the microprocessor 50 to a non-inverting input terminal of each circuit. A smoothing circuit 52*c* formed of a resistor R4 and a capacitor C5 for smoothing the PWM signal from the microprocessor 50 is provided between the microprocessor 50 and the non-inverting input terminal of each circuit.

The PWM signal outputted from the microprocessor 50 is smoothed to a DC voltage in accordance with the duty ratio of the PWM signal by the smoothing circuit 52*c*. The DC voltage is inputted to the non-inverting input terminal of the operational amplifier OP1 in the feedback circuit 52*a* and the non-inverting input terminal of the voltage follower circuit 52*b* and an output voltage of each of the operational amplifiers OP1, OP2 is inputted to the driver 51.

The driver 51 transmits a driving signal for driving the switching element Q1 to the switching element Q1 according to a detected value of the DC voltage Vdc to keep the output of the DC converting circuit 1 substantially constant. The driver 51 also transmits a driving signal for alternately turning on/off the switching elements Q2, Q3 according to the output voltages of the operational amplifiers OP1, OP2, to vary the operating frequency of the inverter circuit 2. That is, the operating frequency of the inverter circuit 2 can be varied by varying the duty ratio of the PWM signal outputted from the microprocessor 50.

An output voltage of the inverter circuit 2 which is detected by the detecting resistor R1 is inputted to the inverting input terminal of the feedback circuit 52*a* through the resistor R3 and the output of the inverter circuit 2 is made substantially constant by feedback control so as to allow the output voltage to substantially coincide with the DC voltage outputted from the smoothing circuit 52*c*. As a result, power supplied to the discharge lamp La is controlled to be substantially constant.

Switches SW1, SW2 are provided between the output terminal of the operational amplifier OP1 and the driver 51 and between the operational amplifier OP2 and the driver 51, respectively. By switching on/off the switches SW1, SW2 according to a signal from the microprocessor 50, the paths to transmit the PWM signal from the microprocessor 50 to the driver 51 can be appropriately switched between the path passing through the feedback circuit 52*a* and the path passing through the voltage follower circuit 52*b*.

In the case where no variation exists in components such as the inductor L2 and the capacitor C2 which form the resonant circuit, no variation occurs in the frequency characteristic of the resonant circuit 3. Thus, when an initial value is read from the EEPROM 53 and the PWM signal is outputted from the microprocessor 50, a target output to the discharge lamp La can be obtained. In fact, however, since variations occur in the frequency characteristic of the resonant circuit 3 due to variations in the components, the output to the target discharge lamp La cannot be obtained merely by reading the initial value. In the present embodiment, the control circuit 5 is provided with an adjustment function to adjust variations in the output to the discharge lamp La due to variations in the components.

The adjustment function serves to adjust variations in the output to the discharge lamp La by repeating a series of operations of comparing and calculating the detected value of the second detection circuit 54 in each of the preheating mode, the starting mode and the lighting mode, with the target range read from the EEPROM 53 in the microprocessor 50, correcting the initial value so that the detected value of the second detection circuit 54 may fall within the target range, and outputting the PWM signal in accordance with a corrected value. In the present embodiment, as an example of a method of determining whether normal lighting is performed or adjustment according to each mode is performed, the EEPROM 53 is provided with a flag. For example, given that "FF" is written into the flag at factory shipment, after power-on, the flag is read from the EEPROM 53 and it is set to make adjustment in the preheating mode and the starting mode when "FF" is written into the flag, make adjustment in the lighting mode when "11" is written into the flag, and perform normal lighting when "00" is written into the flag. Then, when the adjustments in the preheating mode and the starting mode are finished, "11" is written into the flag and when the adjustment in the lighting mode is finished, "00" is written into the flag.

Figure 3:
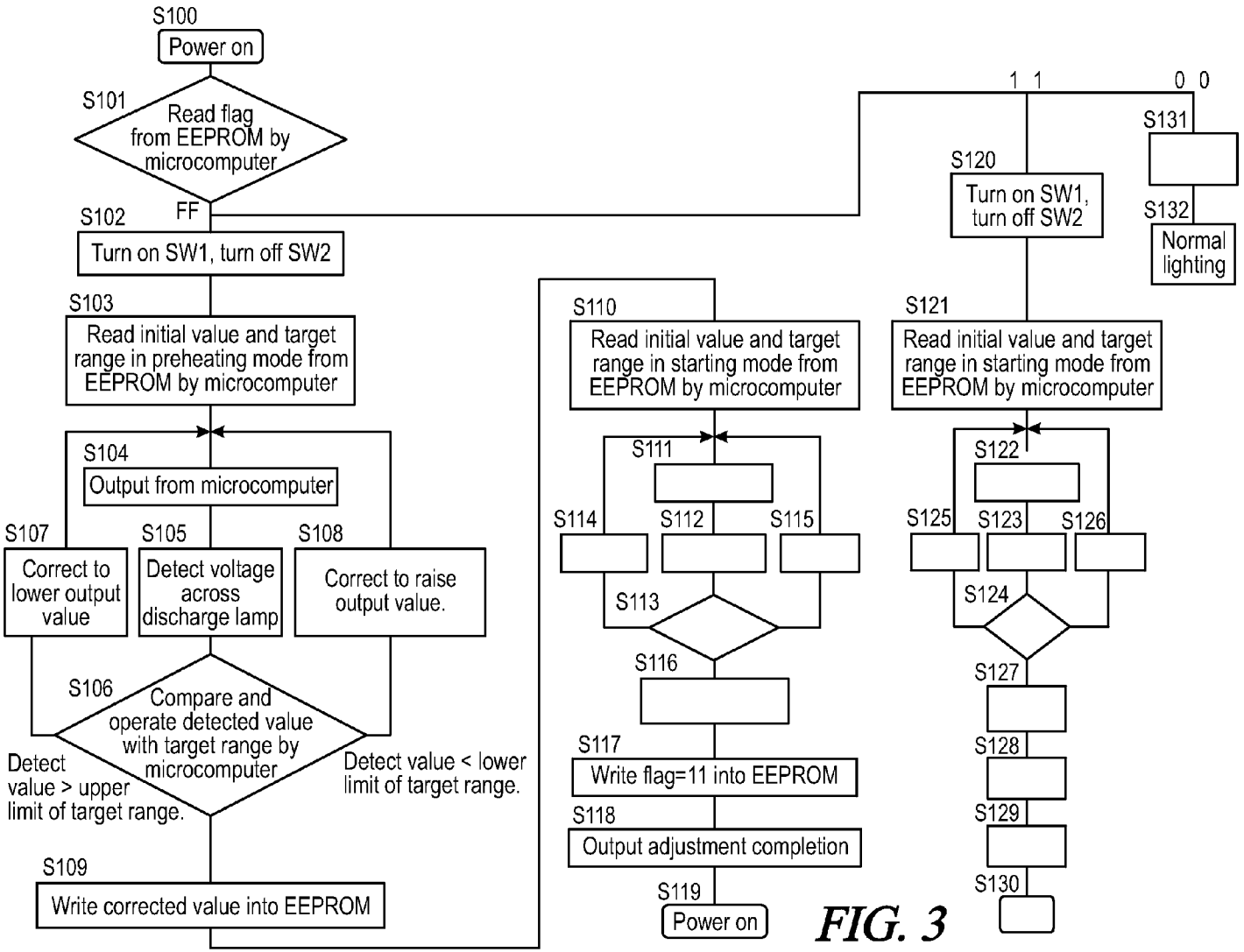
FIG. 3 is a flow chart showing operation of an adjustment function in the embodiment of FIG. 1.

An adjustment method in the present embodiment will be described below referring to FIG. 3. First, the power supply in the present embodiment is turned on (S100) and the flag is read from the EEPROM 53 (S101). At this time, when "FF" is written into the flag, after turning off the switch SW1 and turning on the switch SW2 in the switch circuit 52 (S102), the initial value of the duty ratio and the target range of the output to the discharge lamp La in the preheating mode are read from the EEPROM 53 (S103) and the PWM signal in accordance with the initial value is outputted from the microprocessor 50 (S104). Here, since the switch SW1 is turned off and the switch SW2 is turned on, the PWM signal from the microprocessor 50 is transmitted to the driver 51 through the voltage follower circuit 52*b*.

The voltage V1 across the discharge lamp La is detected by the second detection circuit 54 (S105) and the detected value is compared and operated with the target range in the preheating mode by the microprocessor 50 (S106). As a result of the comparison operation, when the detected value is larger than an upper limit of the target range, the duty ratio is corrected so as to lower the output of the inverter circuit 2 (S107), the PWM signal in accordance with the corrected value is outputted from the microprocessor 50 and the detected value is compared and operated with the target range again.

When the detected value is smaller than a lower limit of the target range, the duty ratio is corrected so as to raise the output of the inverter circuit 2 (S108), the PWM signal in accordance with the corrected value is outputted from the microprocessor 50, and the detected value is compared and operated with the target range again. The above-mentioned operations are repeated until the detected value falls within the target range and when the detected value falls within the target range, the corrected value of the duty ratio at this time is written to the EEPROM 53 (S109) and adjustment in the preheating mode is finished.

Figure 5:
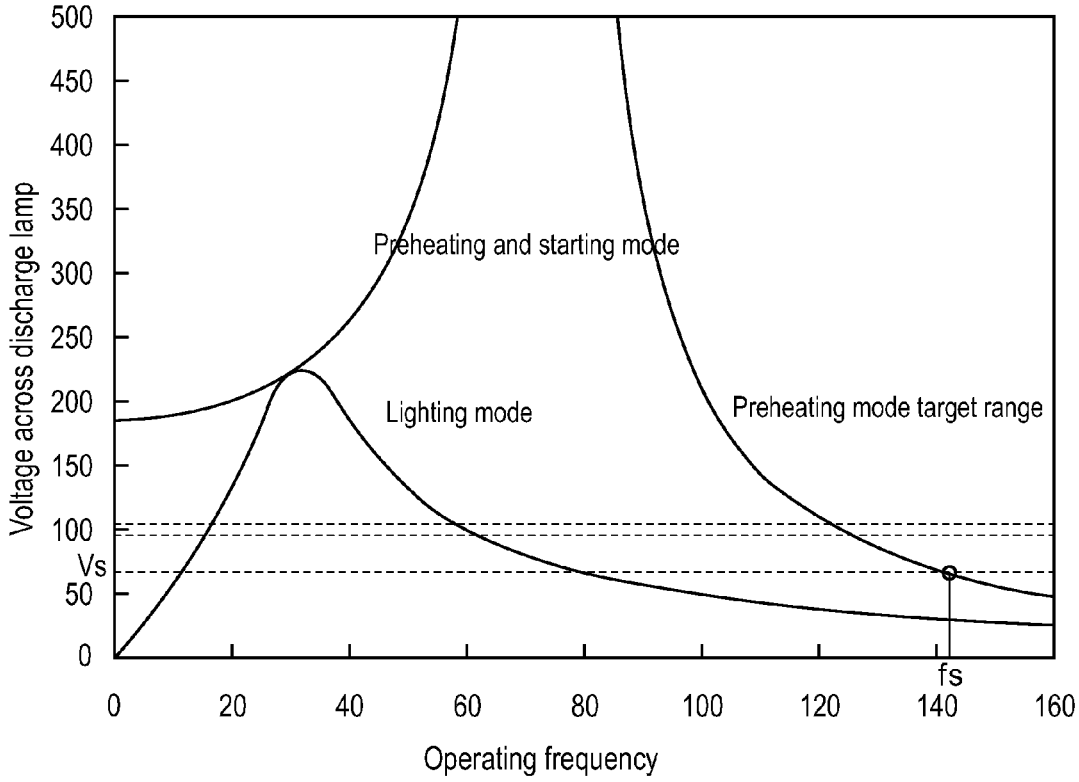
FIG. 5 is a graph showing a specific example of a frequency characteristic of a resonant circuit in the first embodiment.

A specific example of the adjustment in the preheating mode will be described referring to FIG. 5. FIG. 5 shows a resonant curve during non-lighting and a resonant curve during lighting in the case of setting the inductor L2 of the resonant circuit 3 to 1.75 mH, the capacitor C2 to 2700 pF, and the capacitor C3 of the inverter circuit 2 to 13000 pF. Moreover, it is given that the second detection circuit 54 inputs a voltage obtained by dividing voltage V1 across the discharge lamp La by 1/200th to the microprocessor 50 and the target range in the preheating mode, which is written into the EEPROM 53, is 0.5 V to 0.55 V (that is, when converting into the voltage across the discharge lamp La, 100 V to 110 V). Furthermore, by setting the resolution of the PWM signal outputted from the microprocessor 50 to 10 bit and changing the duty ratio of the PWM signal, the operating frequency of the inverter circuit 2 can be varied in the range of 40 kHz to 150 kHz.

When first the initial value of the duty ratio and the target range in the preheating mode are read from the EEPROM 53 and the PWM signal in accordance with the initial value is outputted from the microprocessor 50, the PWM signal is inputted to the driver 51 through the smoothing circuit 52*c* and the voltage follower circuit 52*b*, thereby turning on/off the switching elements Q2, Q3 of the inverter circuit 2 with the operating frequency fs. The voltage V1 across the discharge lamp at this time becomes Vs and the detected value detected by the second detection circuit 54 is compared and operated with the target range by the microprocessor 50. Since the result of the comparison operation shows that the detected value is smaller than the lower limit of the target range, the PWM signal whose duty ratio is increased by one grade is outputted from the microprocessor 50 to lower the operating frequency by (150000−40000)/1024≈107 Hz and raise the output of the inverter circuit 2.

A series of the above-mentioned operations are repeated until the detected value falls within the target range and the duty ratio at the time when the detected value falls within the target range is written into the EEPROM 53 as the corrected value in the preheating mode, thereby completing adjustment. Accordingly, by reading the corrected value written into the EEPROM 53 at completion of adjustment in normal lighting and outputting the PWM signal in accordance with the corrected value from the microprocessor 50, preheating can be performed by the output of the inverter circuit 2 at adjustment irrespective of variations in the components.

When the adjustment in the preheating mode is finished, next, the initial value of the duty ratio and the target range of the output to the discharge lamp La in the starting mode are read from the EEPROM 53 (S110) and the PWM signal in accordance with the initial value is outputted from the microprocessor 50 (S111). Subsequently, the same adjustment operations as those at the above-mentioned S105 to S108 are performed at S112 to S115 and when the detected value falls within the target range, the corrected value of the duty ratio at this time is written into the EEPROM 53 (S116) and "11" is written into the flag, thereby completing adjustment in the starting mode (S117). After that, for example, an arbitrary port of the microprocessor 50 is set to a high level (S118) and the power source in the present embodiment is turned off (S119) so that it can be recognized externally that adjustments in the preheating mode and the starting mode are completed.

Figure 4:
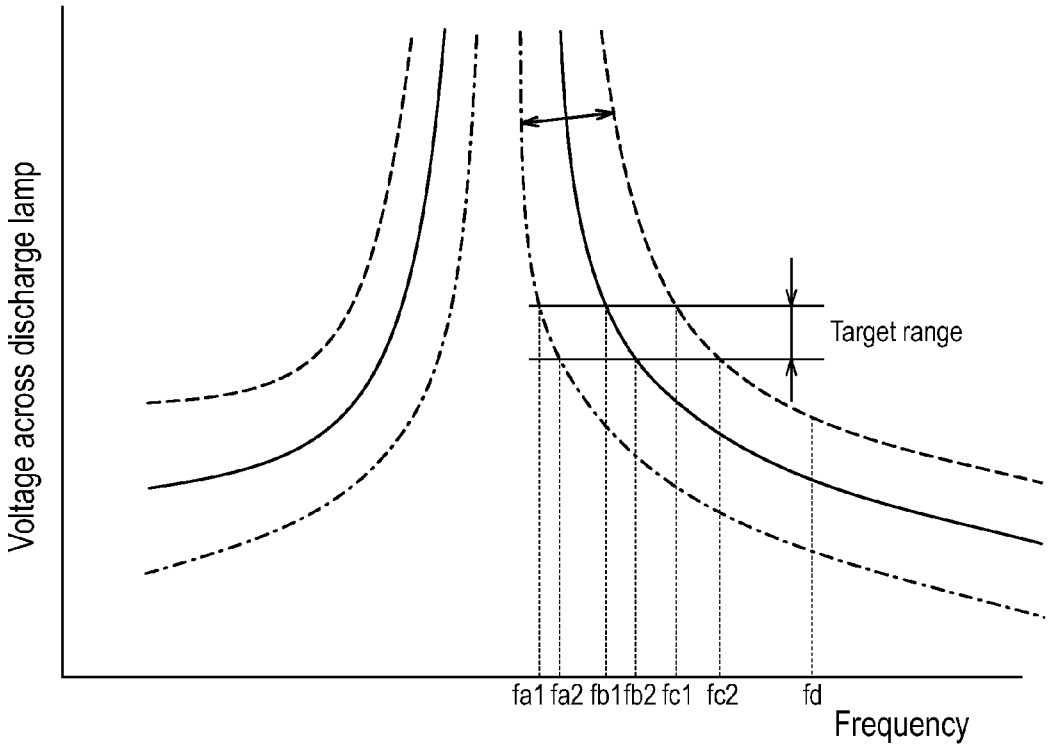
FIG. 4 is a graphical representation of the correlation between variations in resonant curves during non-lighting and an operating frequency, in accordance with a first embodiment of the invention.

Although the adjustment in the starting mode is similar to the adjustment in the preheating mode, the initial value of the duty ratio in the starting mode is set so that the output of the inverter circuit 2 may become sufficiently lower than the target range. For example, as shown in FIG. 4, given that the frequency characteristic of the resonant circuit 3 follows any of resonant curves a, b, c due to variations in the components, the initial value of the duty ratio is set so that a frequency fd which is higher than frequencies fa1, fa2 within the target range in the resonant curve a, frequencies fb1, fb2 within the target range in the resonant curve b and frequencies fc1, fc2 within the target range in the resonant curve c, may become the operating frequency of the inverter circuit 2 at start of adjustment. By setting the initial value so that the output of the inverter circuit 2 at the start of adjustment may be sufficiently lower than the target range irrespective of variations in the component in this manner, the possibility that the output to the discharge lamp La becomes higher than the output in accordance with the target range in the process of adjustment can be lowered, thereby reducing high voltage stresses on the components.

When the power is turned on and the flag is read from the EEPROM 53, since "11" is written into the flag, after turning on the switch SW1 and turning off the switch SW2 of the switch circuit 52 (S120), the initial value of the duty ratio and the target range of the output to the discharge lamp La in the lighting mode are read from the EEPROM 53 (S121) and the PWM signal in accordance with the initial value is outputted from the microprocessor 50 (S122). Here, since the switch SW1 is turned on and the switch SW2 is turned off, the PWM signal from the microprocessor 50 is transmitted to the driver 51 through the feedback circuit 52*a*. Subsequently, the same adjustment operations as those at the above-mentioned S105 to S108 are performed at S122 to S126, and when the detected value falls within the target range, the corrected value of the duty ratio at this time is written into the EEPROM 53 (S127) and "00" is written into the flag, thereby completing adjustment in the lighting mode (S128).

After that, for example, an arbitrary port which is different from the port of the microprocessor 50 is set to a high level (S129) and power in the present embodiment is turned off (S130) so that it can be recognized externally that the adjustment in the lighting mode is completed.

Since the adjustment in each mode is completed in this manner, when power in the present embodiment is turned on next, flag "00" is written from the EEPROM 53 and the switch SW1 of the switch circuit 52 is turned on, the switch SW2 of the switch circuit 52 is turned off (S131) and then, normal lighting is performed (S132). At normal lighting, by reading the above-mentioned corrected value for adjustment in each mode from the EEPROM 53, the output of the inverter circuit 2 at adjustment in each mode is reproduced.

Figure 11A:
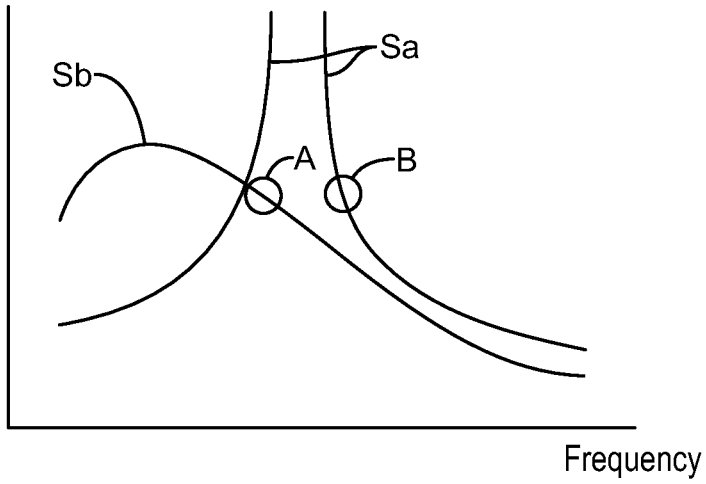
FIG. 11 are graphs of a frequency characteristic of a resonant circuit in the electronic ballast of FIG. 10, wherein FIG. 11(*a*) is a view showing resonant curves during lighting and non-lighting, 11(*b*) is a view showing variations in the resonant curve during non-lighting, and 11(*c*) is a view showing variations in the resonant curve during lighting.
Figure 11B:
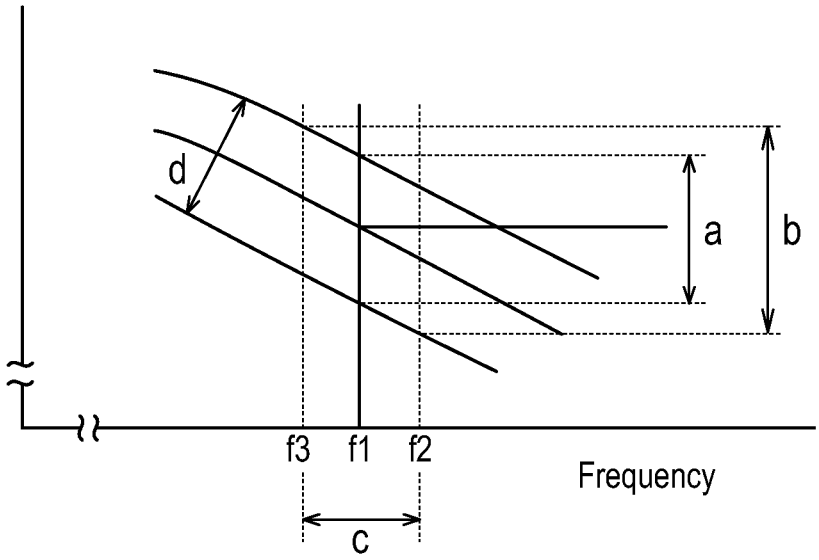
Figure 11C:
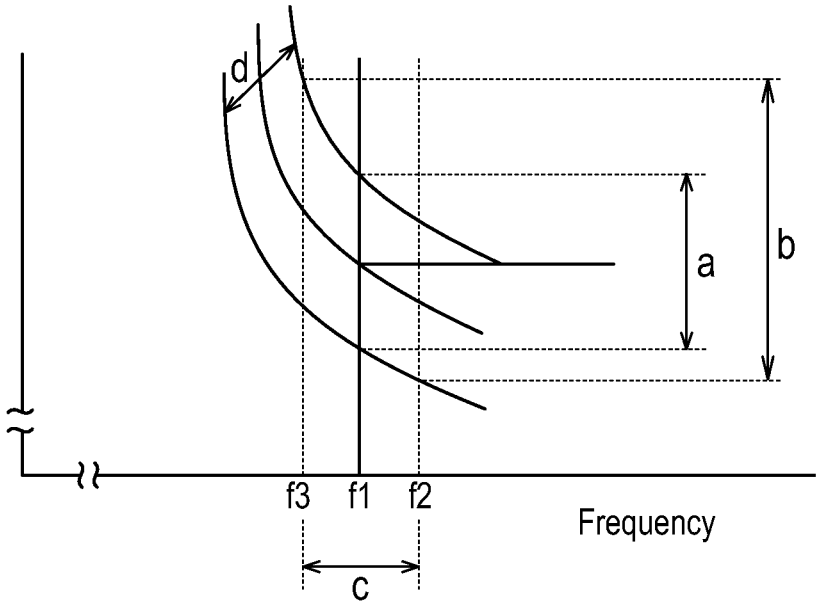
Figure 12:
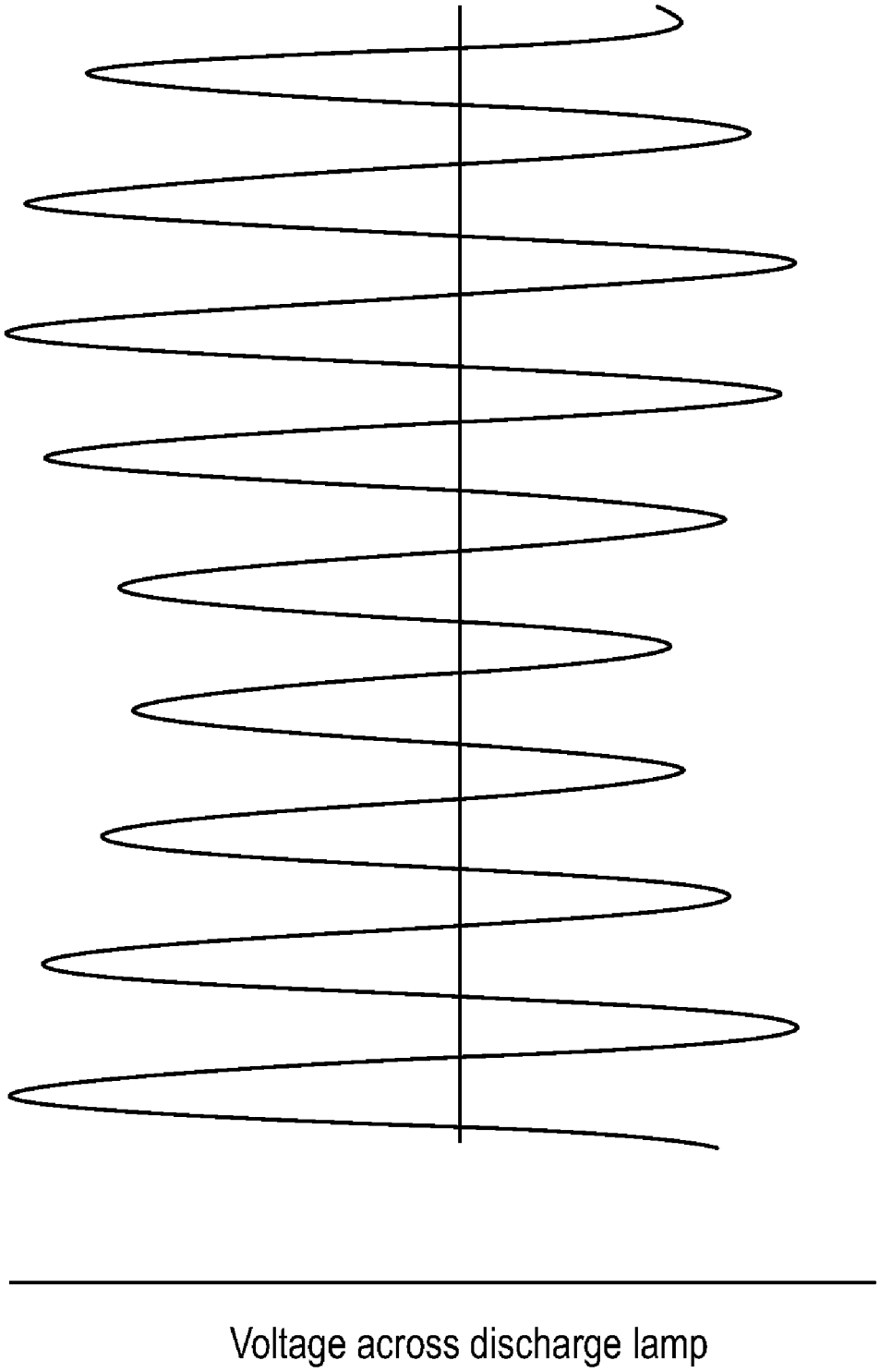
FIG. 12 is a waveform chart showing an example of variations in a voltage across the discharge lamp due to influence of a feedback circuit.

In performing the adjustments in the preheating mode and the starting mode, if an equivalent resistor to the filaments F1, F2 is connected in place of the discharge lamp La, the frequency characteristic of the resonant circuit 3 follows a resonant curve Sa during non-lighting as shown in FIG. 11(*a*) at all times. Furthermore, in performing the adjustment in the lighting mode, if an equivalent resistor to the filaments F1, F2 and an equivalent resistor to the discharge lamp La are connected in place of the discharge lamp La, the frequency characteristic of the resonant circuit 3 follows a resonant curve Sb during lighting as shown in FIG. 11(*a*) at all times. For this reason, in the case of adjustment in the factory, by using the equivalent resistor in place of the discharge lamp La, adjustment can be performed without connecting and lighting the discharge lamp La.

As described above, since the feedback circuit 52*a* for performing feed-back control so that the output voltage of the inverter circuit 2 may substantially coincide with the DC voltage obtained by smoothing the PWM signal from the microprocessor 50 is provided, power supplied to the discharge lamp La can be controlled to be substantially constant. Moreover, in the case where the control circuit 5 has the adjustment function to adjust variations in the output to the discharge lamp La due to variations in the components and performs the adjustments in the preheating mode and the starting mode, since the PWM signal from the microprocessor 50 is transmitted to the driver 51 through the path which does not pass through the feedback circuit 52*a*, it is possible to prevent the feedback circuit 52*a* from affecting the output of the inverter circuit 2 at the adjustments in the preheating mode and the starting mode, resulting in that highly accurate adjustment can be performed both in the preheating mode and the starting mode.

A second embodiment of the electronic ballast according to the present invention will be described below. Since a basic configuration and an adjustment method in the present embodiment are similar to those in the first embodiment, the description of the common features will be omitted. Characteristics in the present embodiment are those related to the adjustments in the preheating mode, and the starting mode in the first embodiment are performed at the same time and a ratio of the frequency in the starting mode to the frequency in the preheating mode or a ratio of the frequency in the preheating mode to the frequency in the starting mode is previously stored in the EEPROM 53.

Therefore, as in the first embodiment, for example, by making adjustment in the preheating mode and calculating the duty ratio of the PWM signal in the starting mode from the corrected value of the duty ratio of the PWM signal according to the ratio read from the EEPROM 53 at completion of the adjustment and setting the duty ratio, the adjustments in the preheating mode and the starting mode can be made at the same time. As a matter of course, when performing the adjustment in the starting mode, as described above, the adjustment in the preheating mode can be performed at the same time according to the ratio read from the EEPROM 53. By simultaneously performing the adjustments in the preheating mode and the starting mode, the adjustment work can be completed within a short time period, leading to an improvement in productivity.

Figure 6:
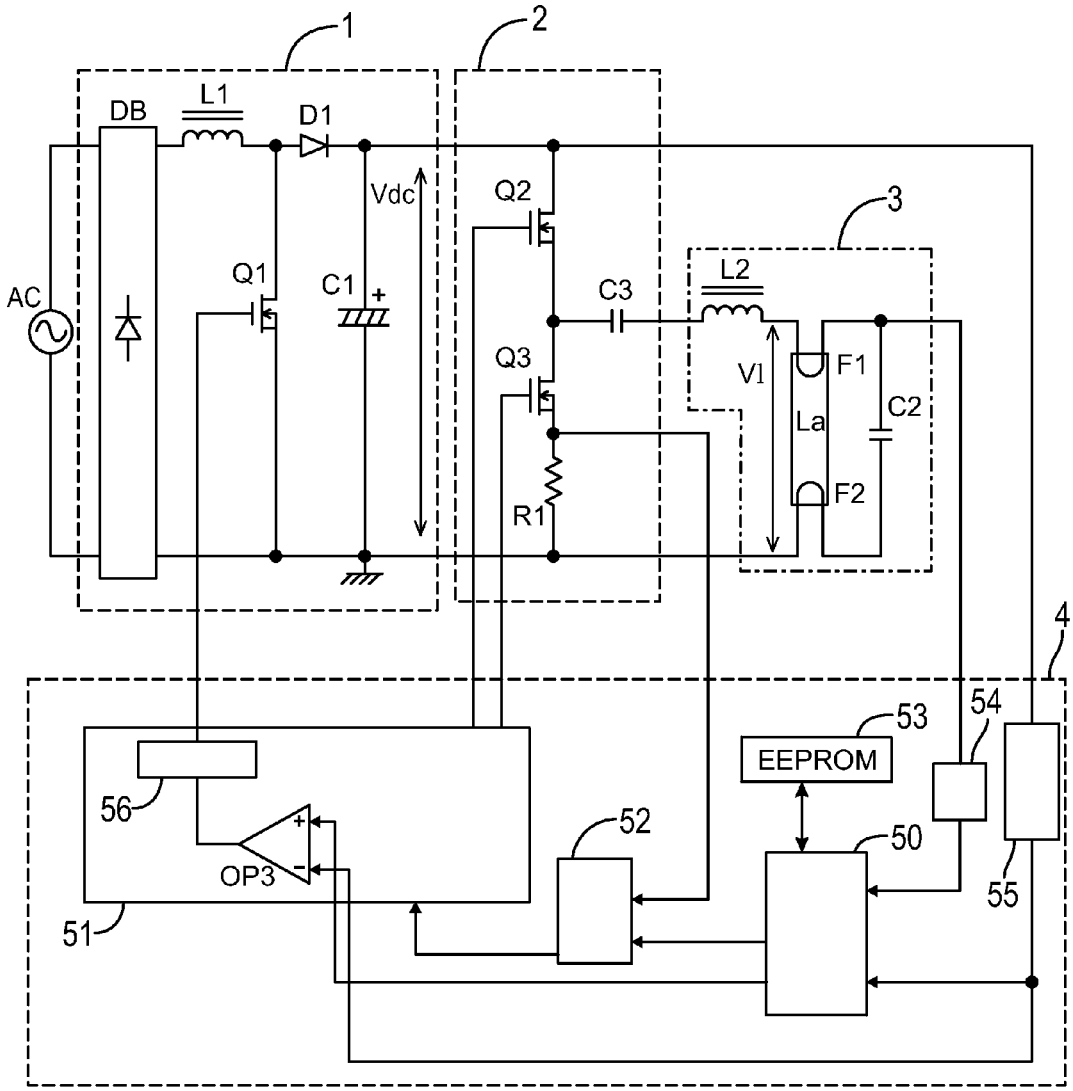
FIG. 6 is a circuit diagram showing a third embodiment of the electronic ballast according to the present invention.

A third embodiment of the electronic ballast according to the present invention will be described below. Since a basic configuration and an adjustment method in the present embodiment are similar to those in the first embodiment, common circuits are given the same reference numerals and the description of the common features will be omitted. In the present embodiment, as shown in FIG. 6, the control circuit 5 is provided with a PFC detection circuit 55 as a third detection circuit for detecting the output of the DC converting circuit 1 and the output of the DC converting circuit 1 is adjusted at stopping of the inverter circuit 2.

Figure 7:
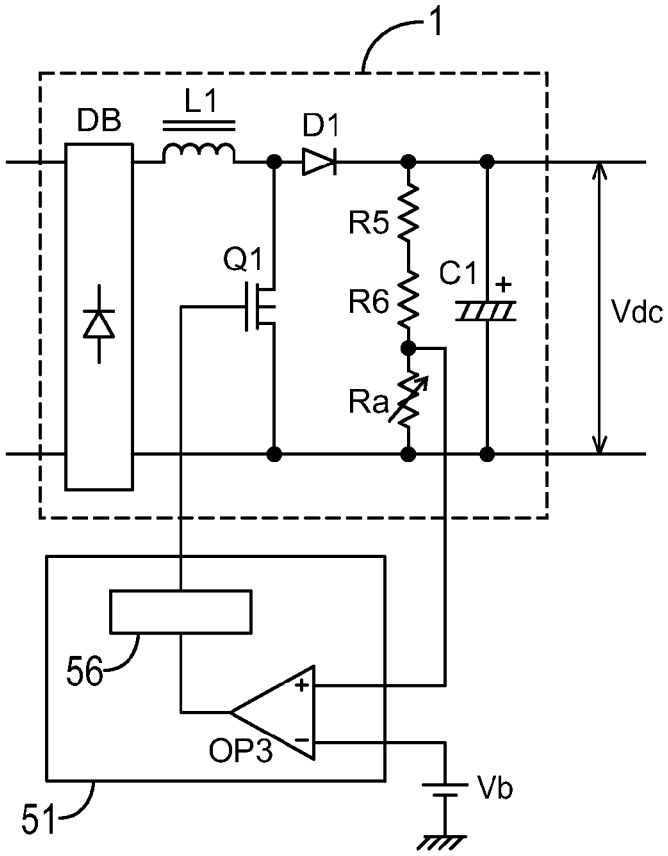
FIG. 7 is a circuit diagram showing a conventional method of adjusting an output of a DC converting circuit.

First, a conventional method of adjusting the output of the DC converting circuit 1 will be described. As shown in FIG. 7, by connecting a series circuit formed of resistors R5, R6 and a variable resistor Ra to the capacitor C1 in parallel in the DC converting circuit 1 and detecting a voltage across the variable resistor Ra, a partial voltage of the output voltage Vdc of the DC converting circuit 1 is detected. The driver 51 is provided with an operational amplifier OP3 which receives inputs of a voltage across the variable resistor Ra at a non-inverting input terminal thereof and a reference voltage Vb at an inverting input terminal thereof and a driving circuit 56 for receiving an output signal of the operational amplifier OP3 and transmitting a driving signal to the switching element Q1. In general, the output voltage Vdc of the DC converting circuit 1 is adjusted to a desired value by adjusting a value of the variable resistor Ra and comparing the voltage across the variable resistor Ra with the reference voltage Vb while monitoring the output voltage Vdc of the DC converting circuit 1 in a manufacturing process.

In the present embodiment, the adjustment of the output voltage Vdc of the DC converting circuit 1 is performed using the microprocessor 50. As shown in FIG. 6, the PFC detection circuit 55 formed of a detecting resistor divides the output voltage Vdc of the DC converting circuit 1 and outputs the divided voltage to each of the microprocessor 50 and the non-inverting input terminal of the operational amplifier OP3 in the driver 51. The microprocessor 50 outputs the PWM signal in accordance with an output of the PFC detection circuit 55 to the inverting input terminal of the operational amplifier OP3. A smoothing circuit, though not shown, is provided on a path from the microprocessor 50 to the inverting input terminal of the operational amplifier OP3 and the PWM signal outputted from the microprocessor 50 is smoothed into a DC voltage in accordance with a duty ratio and then, inputted to the inverting input terminal.

A method of adjusting the output of the DC converting circuit 1 in the present embodiment will be described. First, when power in the present embodiment is turned on, a signal is prevented from outputting from the microprocessor 50 to the driver 51 through the switch circuit 52 and switching of the switching elements Q2, Q3 is stopped, thereby stopping the operation of the inverter circuit 2. In this state, the output voltage Vdc of the DC converting circuit 1 is detected by the PFC detection circuit 55, and a predetermined value of a detecting signal which is found by a voltage division ratio of the PFC detection circuit 55 is compared and operated with the partial voltage of the AC power source AC which is previously stored in the EEPROM 53 to calculate a difference therebetween. Since the difference represents variation in each resistor forming the PFC detection circuit 55, the reference voltage Vb is determined in consideration of the difference.

Figure 8:
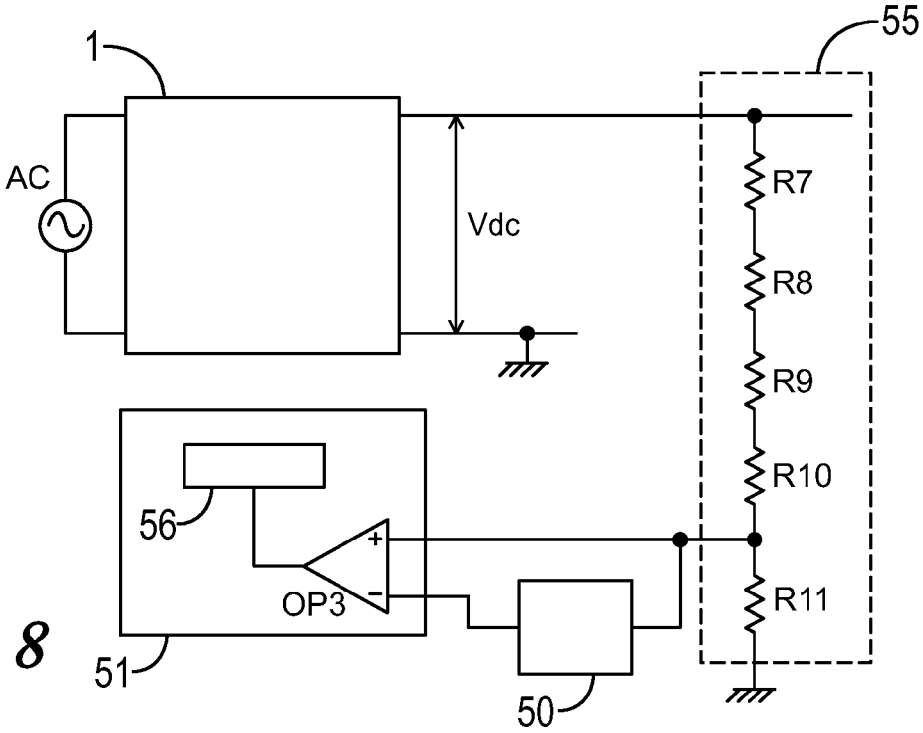
FIG. 8 is a circuit diagram showing a method of adjusting an output of a DC converting circuit in a third embodiment of the invention.

For example, as shown in FIG. 8, given that the PFC detection circuit 55 is constituted of a series circuit including four resistors R7 to R10 having a resistance value of 100 kΩ and a resistor R11 having a resistance value of 5 kΩ and the voltage of the AC power source AC is 100 V, the partial voltage inputted to the microprocessor 50 theoretically becomes $100\ V\times\sqrt{2}\times5/405\approx1.75\ V$. In contrast, given that the partial voltage really inputted to the microprocessor 50 was 1.70 V, it is concluded that the resistors constituting the PFC detection circuit 55 have a margin of error of about 2.86%. The reference voltage Vb can be determined by taking into account variations in the components forming the PFC detection circuit 55 in consideration of the margin of error.

Next, using the duty ratio in accordance with the reference voltage Vb as an initial value, the PWM signal in accordance with the duty ratio is outputted from the microprocessor 50 to the inverting input terminal of the operational amplifier OP3. The output voltage Vdc of the DC converting circuit 1 is then detected by the PFC detection circuit 55 and the detected value is compared and operated with the target range of the output voltage Vdc of the DC converting circuit 1 which is stored in the EEPROM 53. As a result of the comparison operation, when the detected value is larger than the upper limit of the target range, the duty ratio is corrected so as to lower the output of the DC converting circuit 1, the PWM signal in accordance with the corrected value is outputted from the microprocessor 50 and the detected value is compared and operated with the target range again.

Figure 9:
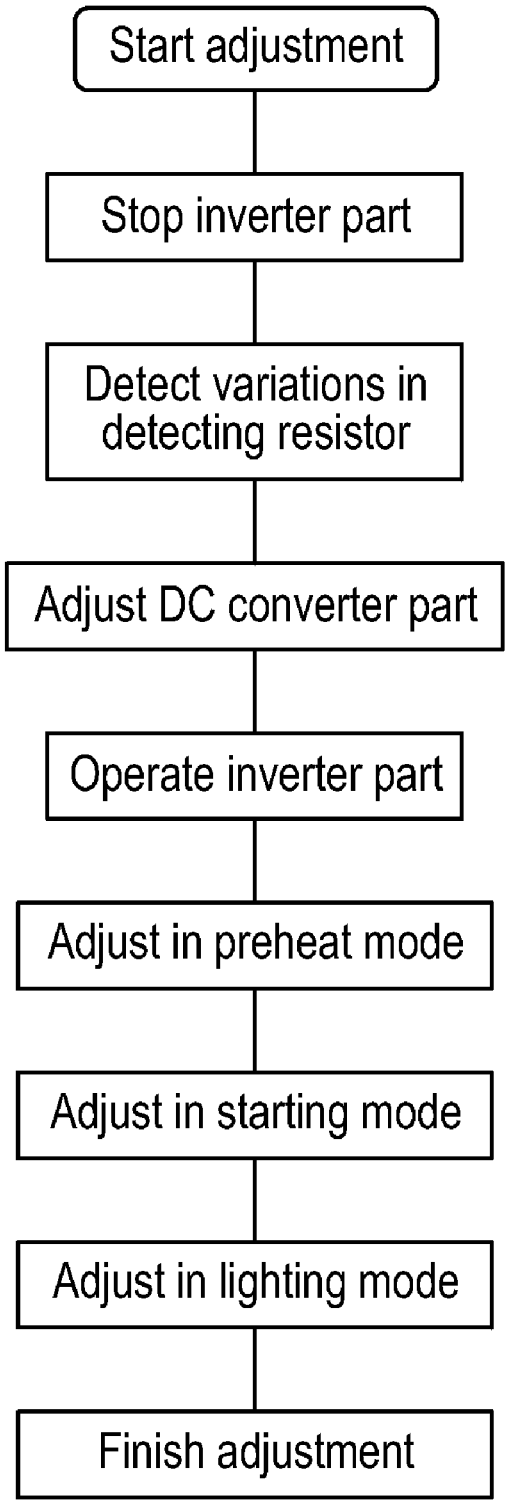
FIG. 9 is a flow chart illustrating the adjusting method of the third embodiment of the invention.

When the detected value is smaller than the lower limit of the target range, the duty ratio is corrected so as to raise the output of the DC converting circuit 1, the PWM signal in accordance with the corrected value is outputted from the microprocessor 50 and the detected value is compared and operated with the target range again. The above-mentioned operations are repeated until the detected value falls within the target range, the corrected value of the duty ratio at the time when the detected value falls within the target range is written into the EEPROM 53 and adjustment of the output voltage Vdc of the DC converting circuit 1 is completed. After completion of the adjustment, as shown in FIG. 9, the inverter circuit 2 is operated to perform adjustments in the preheating mode, the starting mode and the lighting mode as in the first embodiment.

As described above, variations in the output of the DC converting circuit 1 due to variations in the components constituting the DC converting circuit 1 can be adjusted and the output of the DC converting circuit 1 can be adjusted with high accuracy. Moreover, since the reference voltage Vb is determined in consideration of variations in the components constituting the PFC detection circuit 55 before adjusting the output of the DC converting circuit 1, the output of the DC converting circuit 1 can be adjusted with higher accuracy and adjustment of the output of the DC converting circuit 1 can be started from the vicinity of the target range, resulting in reduction of time required for adjustment.

Various lighting fixtures can be constituted of any one of the electronic ballasts in the above-mentioned embodiments, a fixture main body and a socket which is stored in the fixture main body and to which the discharge lamp La is removably attached.

Thus, although there have been described embodiments of the present invention of a new and useful electronic ballast with multimode lamp power control it is not intended that such references be construed as limitations upon the scope of this invention except as set forth in the following claims.

What is claimed is:

1. An electronic ballast comprising:

a DC converting circuit operable to convert an AC output from a commercial power source into a DC output;

an inverter circuit operable to convert an output from the DC converting circuit to a high frequency output, said inverter circuit having an operating frequency determined by a control signal;

a resonant circuit connected to an output end of the inverter circuit, the resonant circuit having a series resonant circuit formed of an inductor and a capacitor and a discharge lamp with the high frequency output supplied thereto from the inverter circuit;

processor having three operating modes including a preheating mode for preheating a filament of the discharge lamp, a starting mode for applying a starting voltage to the discharge lamp, and a lighting mode for supplying power to maintain lighting of the discharge lamp, said processor for providing the control signal to control the operating frequency of the inverter circuit according to each operating mode of the processor;

a first detection circuit operable to detect a voltage of an output of the inverter circuit;

a second detection circuit operable to detect a voltage across the discharge lamp; and a feedback circuit operable to perform feedback control on the control signal so that the detected voltage of the output of the inverter substantially coincides with a predetermined value corresponding to the control signal as provided by the processor, wherein:

the processor has an adjustment function to account for variations in components, the adjustment function causes a storage circuit of the ballast to store a set value of the control signal in corresponding to an operating frequency of the inverter circuit for each of the preheating mode, the starting mode and the lighting mode and a target range, and cause the storage circuit to store a corrected set value obtained by correcting the set value so that the detected voltage across the discharge lamp falls within a target range for each operating mode of the processor, and the processor switches paths to supply the control signal corresponding to the set value to the inverter circuit between a path passing through the feedback circuit during normal operation and a path without passing through the feedback circuit during the adjustment function for the preheating mode and starting mode.

2. The electronic ballast according to claim 1, wherein the set value in the starting mode is corrected so that an output to the corresponding discharge lamp changes from a lower value than an output to the discharge lamp in accordance with the target range in the mode toward the target range.

3. The electronic ballast according to claim 1 or 2, further comprising a third detection circuit operable to detect an output of the DC converting circuit, wherein the control means has a function to stop an operation of the inverter circuit and adjust the output of the DC converting circuit so that a detected value of the third detection circuit falls within the target range.

4. A lighting fixture comprising:

a fixture main body;

a socket accumulated in the fixture main body with a discharge lamp detachably attached thereto; and the electronic ballast according to any one of claims 1 to 3 operable to supply power to the discharge lamp through the socket.

5. An electronic ballast having an inverter circuit operable to provide a high frequency output to a resonant circuit including a gas discharge lamp, said electronic ballast comprising:

a storage circuit operable to store a set value for an operating mode of the electronic ballast, wherein the operating mode of the electronic ballast is a preheating mode or a starting mode;

a processor operable to:

read the set value stored by the storage circuit for the operating mode of the electronic ballast from the storage circuit;

provide a control signal as a function of the set value stored by the storage circuit for the operating mode of the electronic ballast;

adjust the set value stored by the storage circuit for the operating mode of the electronic ballast, said adjusting the set value comprising:

providing the control signal as a function of the set value of the operating mode;

detecting a voltage of the discharge lamp; and correcting the set value stored in the storage circuit for the operating mode until the detected voltage of the discharge lamp is within a target range;

a feedback circuit operable to perform feedback control and adjust the control signal as a function of an output voltage of the inverter circuit to maintain substantially constant power to the discharge lamp; and a switch circuit operable to connect the control signal to the inverter circuit via a path other than the feedback circuit when the processor is adjusting the set value stored in the storage circuit for the operating mode of the electronic ballast.

6. The electronic ballast of claim 5 wherein the processor adjusts the set value stored in the storage circuit for the operating mode of the electronic ballast to account for variations in components of the resonant circuit.

7. The electronic ballast of claim 5 wherein the processor is further operable to adjust a set value stored in the storage circuit for another operating mode of the electronic ballast by determining the set value for the another operating mode as a proportion of the set value for the operating mode.

8. The electronic ballast of claim 5 wherein the switch circuit comprises:

a voltage follower circuit operable to receive the control signal from the processor;

a first switch operable to disconnect an output of the feedback circuit from the inverter circuit when the processor is adjusting the set value stored in the storage circuit for the operating mode of the electronic ballast;

a second switch operable to connect an output of the voltage follower circuit to the inverter circuit when the processor is adjusting the set value stored in the storage circuit for the operating mode of the electronic ballast and disconnect the output of the voltage follower circuit from the inverter circuit when the processor is not adjusting the set value.

9. The electronic ballast of claim 5 further comprising a direct current (DC) converting circuit operable to convert alternating current (AC) output from a commercial power source to a DC output voltage; wherein the processor is further operable to:

stop the inverter circuit from providing the high frequency output to the discharge lamp; and adjust, as a function of the voltage of the discharge lamp, a set value of a variable resistor of the DC converting circuit stored in the storage circuit such that the voltage of the discharge lamp is within a target range of the DC output voltage of the DC converting circuit.

10. The electronic ballast of claim 9 wherein stopping the inverter circuit comprises blocking the control signal from the inverter circuit via the switch circuit.

11. A method of adjusting a set value for an operating mode of an electronic ballast to account for variations in components of a resonant circuit of the electronic ballast, said method comprising:

reading a set value for the operating mode from a storage circuit of the electronic ballast;

providing a control signal from a processor of the electronic ballast to an inverter circuit of the electronic ballast as a function of the set value read from the storage circuit;

switching a path of the control signal from a path including a feedback circuit of the electronic ballast to a path that does not include the feedback circuit;

detecting a voltage of a discharge lamp connected to an output of the electronic ballast; and correcting the set value stored in the storage circuit for the operating mode until the detected voltage of the discharge lamp is within a target range for the operating mode.

12. The method of claim 11 further comprising adjusting a set value stored in the storage circuit for another operating mode of the electronic ballast by determining the set value for the another operating mode as a proportion of the set value for the operating mode.

13. The method of claim 11 wherein the path that does not include the feedback circuit includes a voltage follower circuit.

* * * * *